United States Patent [19]

Luscomb

[11] 4,343,280

[45] Aug. 10, 1982

[54] FUEL DELIVERY CONTROL ARRANGEMENT

[75] Inventor: Douglas A. Luscomb, Mt. Upton, N.Y.

[73] Assignee: The Bendix Corporation, Southfield, Mich.

[21] Appl. No.: 190,127

[22] Filed: Sep. 24, 1980

[51] Int. Cl.[3] ..... F02M 57/02

[52] U.S. Cl. ..... 123/459; 123/458; 123/472

[58] Field of Search ..... 123/458–460, 123/506, 472, 338, 445, 478

[56] References Cited

U.S. PATENT DOCUMENTS

| | | | |
|---|---|---|---|
| 1,664,608 | 4/1928 | French | 123/459 |
| 2,918,048 | 12/1959 | Aldinger et al. | 123/459 |
| 3,741,182 | 6/1973 | Wade et al. | 123/459 |
| 3,779,225 | 12/1973 | Watson et al. | 123/472 |
| 3,796,205 | 3/1974 | Links et al. | 123/458 |
| 3,796,206 | 3/1974 | Links | 123/445 |
| 4,129,253 | 12/1978 | Bader, Jr. et al. | 239/88 |
| 4,185,779 | 1/1980 | Watson | 123/472 |
| 4,211,202 | 7/1980 | Hafner | 123/472 |

FOREIGN PATENT DOCUMENTS

| | | | |
|---|---|---|---|
| 55-112857 | 9/1980 | Japan | 123/459 |

*Primary Examiner*—Ira S. Lazarus
*Assistant Examiner*—Magdalen Moy
*Attorney, Agent, or Firm*—John R. Benefiel; Raymond J. Eifler

[57] ABSTRACT

A valving arrangement is disclosed for varying the quantity and timing of fuel injections of a jerk pump (10) associated with an internal combustion engine. The arrangement consists of a bypass valve (40) in communication with the injection chamber (22) of the jerk pump (10) which produces a controlled bypass of fuel rather than being delivered through the injector delivery valve (42) to the engine cylinders. The bypass valve (40) in turn is controlled by a solenoid-operated three-way pilot valve (88) which causes pressurizing or venting of an operating chamber (84) adjacent a bypass valve operator piston (80). The three-way pilot valve (88) in turn is controlled by the fuel system electronic controls (98) to control the timing and volume of fuel charge delivered by the jerk pump (10) in each injection cycle.

14 Claims, 2 Drawing Figures

PRESSURE SOURCE
ELECTRONIC FUEL CONTROL SYSTEM
FUEL SUPPLY LOW PRESSURE
54
92
94
38
104
102
88
96
52
90
82
84
86
56
80
46
66
78
40
100
36
68
70
60
42
62
98
58
76
44
64
48
50
74
72
32
26
35
34
28
22
18
20
24
10
16
14
12

FUEL DELIVERY CONTROL ARRANGEMENT

This invention relates to fuel injectors for internal combustion engines and more particularly to mechanically operated fuel injectors of the so-called jerk pump type, commonly employed for fuel injection in diesel engines. Such jerk pumps comprise a plunger disposed in an injector barrel. The plunger is mechanically driven by the engine as by a driving connection with the engine cam shaft such as to produce an injection of fuel by movement of the plunger in the barrel at the appropriate point in the engine cycle towards an injection chamber. The increased pressure in the injection chamber causes the opening of an injection delivery valve to thereby cause injection of the fuel charge into the associated engine cylinder.

Since it is necessary to control the quantity of fuel injected into the chamber for each injection cycle and also the timing of such fuel injection, it has been the practice to form the plunger with a helical groove which cooperates with ports formed in the barrel to control the bypass of fuel from the injector chamber. Means are also typically provided for relatively rotating the plunger within the barrel to produce a variation in bypass flow and hence in the quantity and timing of fuel injection in a given injection cycle.

This arrangement is relatively simple and reliable and has found widespread application. However, the limits within which the quantity and timing parameters of fuel injection may be varied by such grooves and ports are such that it is difficult to achieve precise control over these parameters for maximum engine efficiency and/or emission control.

This limitation of this approach has also required different jerk pump configurations for different engine families, increasing the manufacturing and maintenance costs associated with the jerk pumps.

In an effort to provide such improved control over these parameters, there has heretofore been suggested arrangements for electrical control over the injection consisting of valving means and associated intensifiers which are operated wholly by electronic fuel control systems.

Such arrangements as have heretofore been provided have however been relatively complex in comparison to the mechanically operated jerk pumps. For this reason, further efforts have been exerted by those working in the art to develop a jerk pump valve control arrangement in which precise electronic control may be achieved over the duration and timing of fuel injection of a basically mechanically timed jerk pump. Such arrangements are disclosed in U.S. Pat. Nos. 3,779,225; 4,129,253; 4,129,254; 4,129,255 and 4,129,256.

In these arrangements, the jerk pump plunger is operated by a mechanical drive mechanism with flow control achieved by modulating the fuel injection flow from the injection chamber, the modulation under the control of an electronic fuel control system. Difficulties are encountered in attempting to directly valve the injection flow due to the high pressures involved and the rapid response times required.

Accordingly, such valving arrangements which have heretofore been provided necessitate complex accumulators and/or high powered solenoid valves. Or, in the arrangement of U.S. Pat. No. 3,779,225, leakage may be present in the control valving which affects the preciseness and efficiency of the injection process.

Another desirable feature which has not heretofore been provided in this context is a failsafe operation of the fuel supply to the injection chamber, such that upon failure of the fuel delivery control, fuel to the injection chambers is cut off, or bypassed during stroking of the plunger to eliminate an engine runaway condition.

SUMMARY OF THE INVENTION

The present invention achieves a solution to these problems with electronically controlled bypassing of the injection flow from the injector chamber of a mechanically operated jerk pump in which leak free valving of the flow is achieved for precise control over the injection process. A relatively low powered rapid acting solenoid is employed to control the bypass flow enabled by the particular arrangement employed to control the bypass flow. The supply of fuel to the injection chamber is automatically discontinued upon malfunction of the bypass flow valving tending to enable full charge injection of the jerk pump plunger. Also, if other failures occur, the stroking of the plunger produces complete bypass of the fuel, both of these features combining to afford a degree of failsafe operation.

The invention is characterized by a bypass valve associated with the injection chamber of a mechanically driven jerk pump which is opened and closed by operation of a three-way pilot valve to control the quantity and duration of fuel injection by the jerk pump plunger. The three-way pilot valve does this by the application or venting of pressure to a bypass valve operating chamber which acts on the bypass valve sleeve member to cause it to be seated or unseated on a conical valve seat. Upon unseating of the sleeve member injection ceases due to the decline in pressure in the injection chamber and is initiated by seating of the sleeve member. Fuel is supplied to the injection chamber by reverse flow therethrough the bypass passage from the fuel supply source such that if the bypass valve malfunctions by remaining closed, injection is discontinued since fuel is no longer supplied to the injection chamber.

If the components malfunction so as to result in the bypass valve remaining open, the fuel is merely bypassed during stroking of the plunger.

The three-way valve operates with relatively moderate pressures (compared to the injection pressure) from a secondary pressure source such that it may be operated with a relatively low powered solenoid and can be of extremely rapid response.

It is an advantage of the present invention that improved flexibility and precision of control over the quantity and timing of fuel injection for jerk pump injectors is achieved.

It is another advantage of the present invention that such controls may be integrated into an electronic control system to exercise optimum control over the timing and quantity of fuel injection while utilizing a relatively simple and reliable jerk pump injector.

It is still another advantage that such arrangement which incorporates solenoid valving may be relatively low powered while providing rapid response time, which valving controls fuel flow efficiently with minimal leakage.

It is yet another advantage of the present invention to provide such electronically controlled valving for jerk pump injectors which are relatively simple in configuration and do not require the use of complex valving.

It is also another advantage of the present invention to provide a failsafe operation in that supply of fuel to the injector is cutoff in the event of malfunction of the control valving.

DETAILED DESCRIPTION OF THE INVENTION

Figure 1:
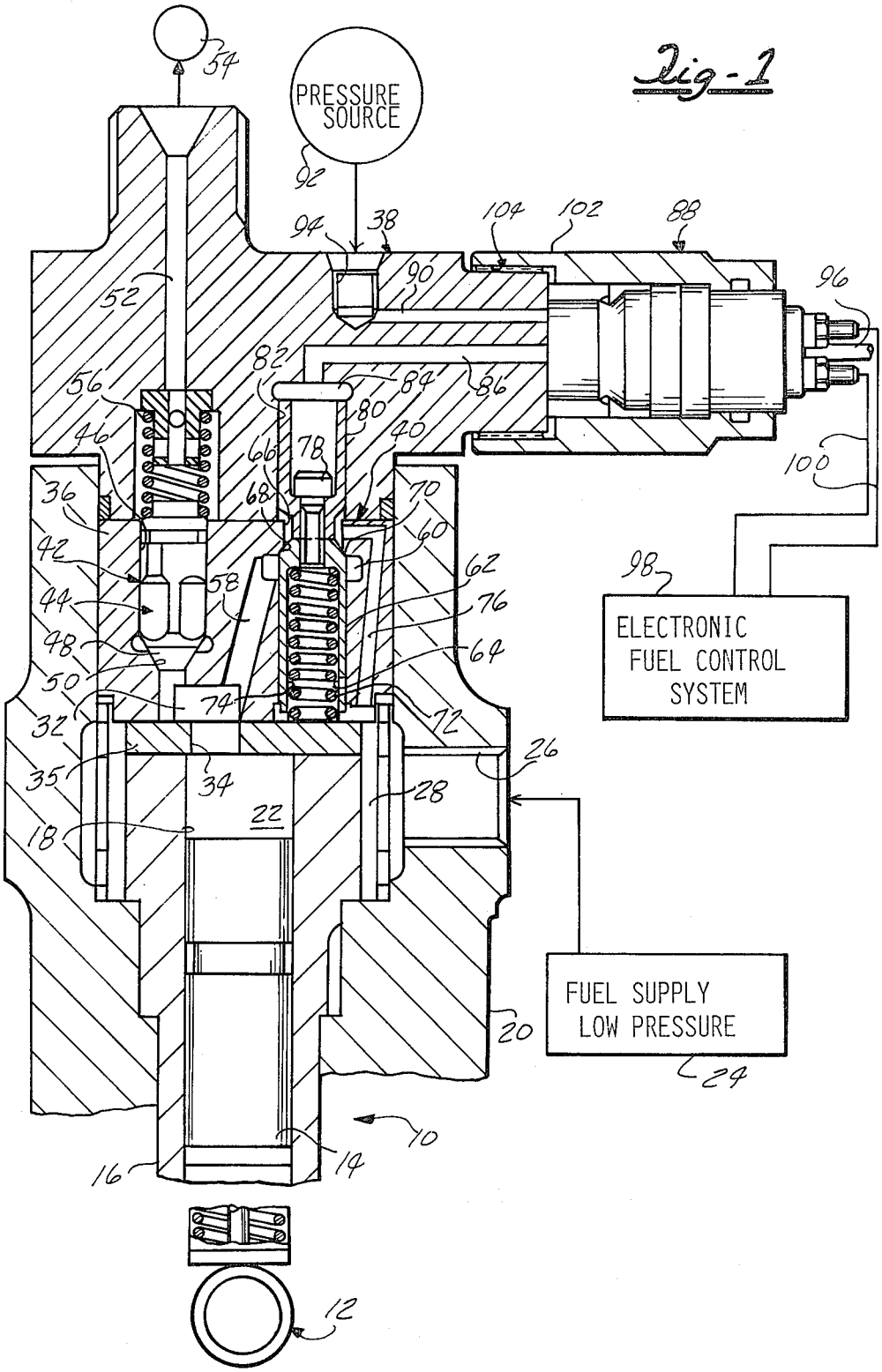
FIG. 1 is a partially sectional view of the jerk pump injector unit incorporating the control valving according to the present invention, with a block diagrammatic representation of the associated system components.

In referring to the drawings in the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

As developed above, the present invention is concerned with injectors, particularly injectors for diesel engines in which a quantity of fuel is injected into each engine cylinder at particular points in time in the engine cycle.

A jerk pump and injector are associated with each engine cylinder which causes a quantity of fuel to be injected into each engine cylinder to initiate the combustion cycle within the cylinders.

Each of the jerk pumps are mechanically driven by the engine as by a drive mechanism associated with the engine cam shaft or crank shaft to cause the properly timed pressurization of each jerk pump injection chamber at appropriate points in the engine cycle.

Referring to FIG. 1, a jerk pump 10 of this type is depicted with an engine driven cam follower mechanism 12 causing timed reciprocation of a plunger 14 within a barrel member 16 having an appropriate internal bore 18 slidably receiving the plunger 14. The barrel member 16 in turn is mounted within a jerk pump housing 20.

The plunger 14, when reciprocated by the cam follower mechanism 12, moves into the region above its upper surface thereof defining an injection chamber 22.

The injection chamber 22 in turn receives a supply of fuel from a secondary low pressure, i.e., 50 psi, fuel supply source 24 in communication with the inlet port 26 and a relief passage 28 by reverse flow through bypass valving means 40, as will be described below, and passing into the injection chamber 22.

As shown in FIG. 1, the injection chamber 22 is also in communication with a chamber 32 via opening 34 formed in a spacer 35 positioned atop the end face of the barrel member 16.

The chamber 32 is formed in a lower valve body 36 received within a jerk pump housing 20 and mounted intermediate the spacer 35 and an upper valve body 38, all assembled together within the jerk pump housing 20 as shown in FIG. 1.

The chamber 32 is in communication with both bypass valving means indicated at 40 and with a delivery injector valve 42.

Delivery injector valve 42 includes a valve member 44 disposed within the bore 46 formed in the lower valve body 36 having a conical face 48 adapted to be seated on a valving seat 50 to control communication with a passage 52, in turn communicating with a cylinder injector nozzle indicated diagrammatically at 54 in FIG. 1.

Delivery valve member 44 is biased towards the closed position by means of a compression spring 56 such that upon development of a predetermined pressure in the injection chamber 22 and chamber 32, the injector valve member 44 opens against the resistance of the compression spring 56 and residual pressure existing upstream in passage 52 to allow fuel flow to the cylinder injector nozzle 54.

As shown in FIG. 1, the bypass valving means 40 is in communication with the injection chamber 22 via chamber 32, opening 34 and a cross passage 58 formed in the lower valve body 36 which in turn opens into an annular chamber 60 surrounding a bypass valve sleeve member 62, slidably disposed in a bore 64 formed in the lower valve body 36.

The annular chamber 60 opens into a smaller bore 66 via a tapered valve seat 68. Bypass valve sleeve member 62 is provided with a mating tapered valve surface 70 and a compression spring 72 disposed within a bore 74 formed in the bypass valve sleeve member 62, causing the valve surface 70 to be urged into engagement with the valve seat 68. Thus, cross passage 58 leading from the injection chamber 22 and chamber 32 is normally blocked by bypass valving means 40.

The line of contact between the tapered valve seat 68 and valve surface 70 is at the outer diameter thereof so that when seated, no hydraulic pressure acts on the sleeve member 62 tending to act against the compression spring 72.

The smaller bore 66 is in communication with the bypass passage 76 placed in communication with the relief passage 28 to thus be in communication with fuel supply source 24.

The bypass valve sleeve member 62 is secured by means of a cap screw 78 to a bypass valve operator piston 80 slidably disposed in a bore 82 formed in the upper valve body 38. The bore 82 empties into an operating pressure chamber 84 which in turn is in communication with a passage 86 formed in the upper valve body 38.

The bypass valve operator piston 80 is secured to the sleeve member 62 to reduce any hydraulic forces present on the sleeve member 62 when fuel is moving through cross passage 58 and into the bypass passage 76. Thus, when pressure from the operating chamber 84 is caused to decline, as will be described, the compression spring 72 immediately causes sleeve member 62 to close unresisted by any hydraulic forces acting against the force exerted by the compression spring 72.

This condition also acts to balance the hydraulic forces acting on the bypass valve operator piston 80 upon unseating which would tend to resist the downward opening movement as viewed in FIG. 1 of the operator piston 80 in moving to unseat the sleeve member 62. For this reason, these elements are of the same diameter to properly balance these hydraulic forces in these two instances.

As FIG. 1 also shows, mounted to upper valve body 38 is a solenoid operated three-way pilot valve 88 which controls communication of the passage 86 and operating pressure chamber 84 with a passage 90 which receives fluid pressure from a secondary moderate pressure source 92 via inlet port 94 formed in the upper valve body 38. Such pressure source 92 may be provided by a pump pressurizing fuel to sufficient levels to properly operate the bypass valving means 40, i.e., 500–2000 psi, and any accumulator which may be required to meet the demand with a given pump design.

The three-way pilot valve 88 is operable to place the passage 86 in communication with the pressurized fuel source 92 or in another mode to communicate the passage 86 with a dump passage 96 in communication with a low fluid pressure region, such as the fuel tank (not shown).

The three-way pilot valve 88 is adapted to be operated electronicaly as under the control of the electronic fuel control system 98 via electrical leads 100.

The three-way pilot valve 88 is mounted to the upper valve body 38 by means of a retainer sleeve 102 engaging the threads 104 formed on a boss portion of the upper valve body 38.

Figure 2:
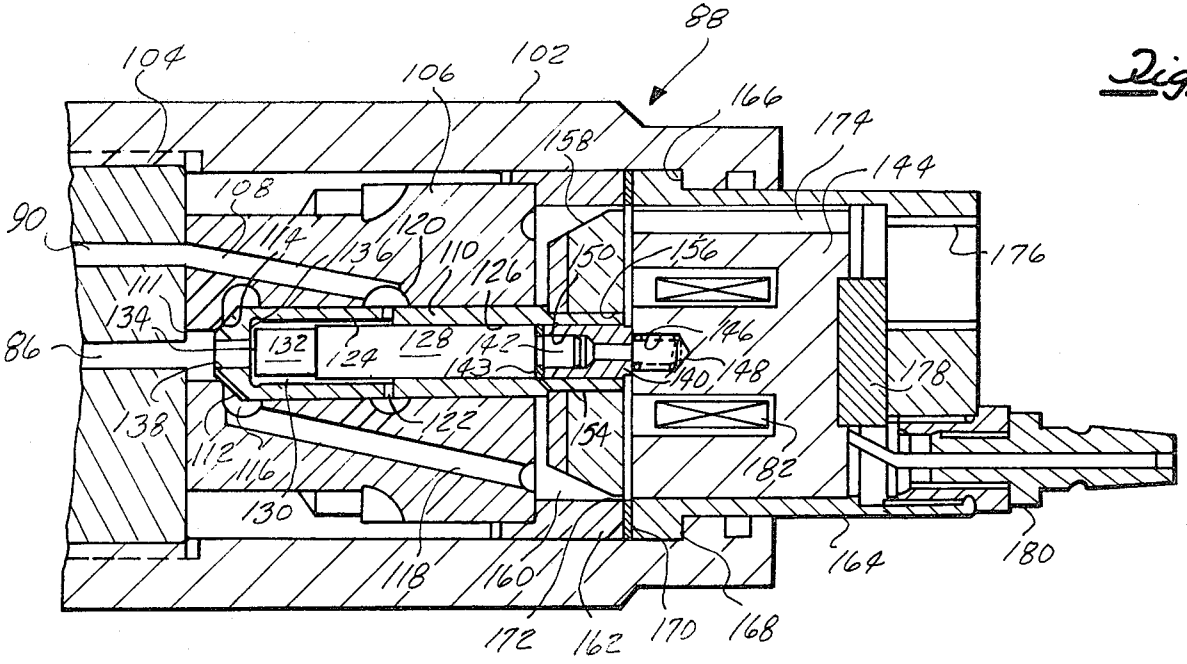
FIG. 2 is a sectional enlarged view of the three-way pilot valve shown in FIG. 1 revealing the interior details thereof.

The details of the three-way pilot valve 88 can be understood by reference to FIG. 2. Such valve is of a known type as disclosed in U.S. Pat. No. 4,185,779, assigned to the same assignee as the present application.

The three-way pilot valve 88 includes a valve body 106 which is formed with an internal passage 108 mounted in line with passage 90 and with a central opening 111 mounted in alignment with the passage 86. Slidably mounted in the valve body 106 is a sleeve valve 110 having a conically shaped valve face 112 adapted to cooperate with the conical valve seat 114 opening into the central opening 111. Central opening 111 in turn opens into an annular opening 116 which is in communication with a cross passage 118.

As shown in FIG. 2, the cross passage 108 in turn is in communication with an annular 120 into which enters a cross port 122 formed through the sidewall of the sleeve valve 110 and entering into a clearance space 124 existing between an interior bore 126 and the sleeve valve 110 and a post valve 128, and thence into an enlarged clearance space 130 between a reduced diameter end section 132 of the post valve 128.

The end face 134 of the reduced diameter end section 132 acts as a valving surface moving towards and away from an axial face 136 adjacent a bore 138 formed through the endwall of the sleeve valve 110.

The post valve 128 pilots a smaller diameter element 140 disposed within the interior bore 126 of the sleeve valve 110. The spacer element 140 is of nonmagnetic material such as brass to maximize the flux passage through the armature member 158, described below.

FIG. 2 also shows the post valve 128 formed with a pilot section 142 fitted in a bore 150 of the spacer element 140 with a vent 152 being provided to prevent separation between these components due to hydraulic pressures which might otherwise be generated in the intermediate space. A shim disc 143 is disposed intermediate the spacer element 140 and the post valve 128 of a thickness necessary to precisely control the axial position of the end face 134.

The sleeve valve 110 is formed with a reduced diameter section 154 which is press fitted in a bore 156 formed in an armature member 158 so as to be moved together with the sleeve valve 110.

The spacer 140 abuts against an electromagnetic body member 144 adjacent a pocket 146 containing a bias spring 148 urging the post valve 128, acting through the spacer element 140, to the left as viewed in FIG. 2, closing the bore 138 by the consequent positioning of the end face 134 thereagainst.

Armature member 158 is disposed in a large diameter interior bore 160 of an annular spacer 162 disposed adjacent the valve body 106 and a coil housing 164, all of these elements being retained together in axial abutment by the retainer sleeve 102 via a flange portion 166 in abutment with a shoulder 168 of the coil housing 164.

Annular sleeve 162 is received over the end of the valve body 106 and affixed thereto.

A gasket 170 is provided intermediate the opposing faces of the annular spacer 162 and the coil housing 164.

The armature member 158 is of lesser diameter than the interior bore 160 such that an annular clearance space indicated at 172 and a pair of opposite flats (not shown) afford fluid passage about the outside of the armature member 158, armature member 158 being centered in the interior bore 160 by virtue of being piloted on the sleeve valve 110.

As shown in FIG, 2, there extends between the coil core 164 a flow passage 174 which is in communication with a drain port 176 adapted to be communication with the dump passage 96. The coil housing 164 also houses a spacer 178 and suitable fittings 180 for receiving the electrical lines, only one of which is shown in FIG. 2. The coil housing 164 houses the electromagnetic coil 182 which is energized via the electrical leads 100.

OPERATION

In operation, the three-way pilot valve 88 receives fuel under pressure via internal passage 108 and passage 90 to pressurize the annulus 120, clearance space 124, bore 138 and passage 86 so long as the electromagnetic coil 182 is deenergized. Flow through the bore 138 causes the sleeve valve 110 and attached armature member 158 to move to the position shown in FIG. 2. The line of contact between valve seat 114 and valve face 112 is such that a lesser area of the valve face is subjected to pressure than the interior face of the sleeve valve 110, biasing the sleeve valve 110 into the position shown in FIG. 2.

At the same time, the mating valve surface constituted by the valve seat 114 and valve face 112 precludes communication of the passage 86 with the cross passage 118 such that passage 86 is pressurized to the pressure level of source 92. Upon energization of the electromagnetic coil 182, the armature member 158 is drawn towards the magnetic body member 144. This movement causes the pressure to immediately drop in bore 138 by seating end face 136 against end face 134, shutting off the application of source 92 to the passage 86 and at the same time communicating the passage 86 to drain open seats 112 and 114 via the cross passage 118, interior bore 160, flow passage 174 and dump passage 96.

The armature member 158 seats against the post valve end face 134 and abutting spacer element 140 in moving towards the face of the magnetic body 144, with a slight clearance space between the armature member 158 and the opposing face enabling tight seating of the end faces 134 and 136.

By a relatively slight axial movement of the armature member 158, the valving action is essentially complete. That is, the post valve 128 and sleeve valve 110 rapidly come together to close off the pressure from the internal passage 108.

It should be noted that in the unenergized condition, the pressure in the clearance space 130 acts against the end face of the post valve 128 to overcome the influence of the bias spring 148, thus holding the post valve 128 in its extreme rightmost position as viewed in FIG. 2.

In the energized mode, the differential diameter of the post valve 128 serves to also hold the post valve 128 to the right, as well as to create a hydraulic separating bias force acting on the sleeve valve 110 and post valve 128. This causes the sleeve valve 110 to rapidly move to the left upon deenergization of the electromagnetic coil 182.

Accordingly, if the electromagnetic coil 182 is unenergized, the resulting pressurization of the operating pressure chamber 84 by the three-way pilot valve 88 causes the operator piston to overcome the bias of compression spring 72. This in turn causes the bypass valve sleeve member 62 to be moved such that the valve surface 70 is moved off the valve seat 68 allowing communication of the cross passage 58 to be established to the bypass passage 76. This reduces the pressure in the injection chamber 22 such that the pressure declines below that necessary to open the delivery valve member 44.

This also enables filling flow from the fuel supply 24 to enter the injection chamber 22 via passage 76, bore 66, passage 58 and chamber 32. This would occur during downstroke and neutral motion of the plunger 14.

Accordingly, if the cam follower mechanism 12 has caused the plunger 14 to be elevated so as to create a tendency for a pressure rise in the injector chamber 22 sufficient to unseat the delivery valve member 44, with the electromagnetic coil 182 of the three-way pilot valve 88 being in the deenergized condition, the pressure in the injection chamber 22 will not increase sufficiently to enable the delivery valve member 44 to open.

Upon energization of the electromagnetic coil 182 of the three-way pilot valve 88, the passage 86 is placed in communication with a low pressure region to depressurize operating chamber 84.

The relatively low pressure existing in the bore 82 enables the compression spring 72 to force the bypass valve sleeve member 62 to the closed position as shown in FIG. 1. In this position, the cross passage 58 is no longer in communication with the bypass passage 76 and pressure is allowed to rise in the injection chamber 22 to the point whereat the delivery valve member 44 will open and injection begins.

The duration of the period of injection controls the quantity of fuel injected and the time period during which the three-way pilot valve 88 is energized, in turn controlling the quantity of fuel injected.

It should be noted that if due to malfunction the bypass valve means 40 remains closed, fuel delivery will cease since filling flow cannot enter the injection chamber 22. If bypass valve means 40 remains open, injection will still not occur since all of the fuel is bypassed during stroking of the plunger 14. This affords a degree of failsafe operation preventing engine runaway under these circumstances.

Accordingly, it can be appreciated that the above-recited objects of the present invention have been achieved by the combination of a bypass valve associated with the injection chamber which is operated by means of a three-way pilot valve controlling relatively moderately pressurized fuel to enable a very rapid and precise control over the injection process by means of a low powered solenoid operator. The bypass valve acts to precisely and efficiently control the fuel flow by the leakfree valving incorporated therein. The overall arrangement is relatively simple and reliable in operation.

Also, the electronic control of the bypass valve affords a good degree of flexibility in control over the timing and quantity of fuel injected over wide ranges to thus obviate the disadvantages of the groove and port arrangements, and dispensing with the need for a variety of different grooves and port designs for different engine families.

Finally, the fill-during-bypass and the bypass mode of control afford the failsafe feature described above.

I claim:

1. A jerk pump assembly for an internal combustion engine of the type including at least one engine cylinder, at least one corresponding fuel injector nozzle associated with said at least one cylinder to direct the injection of fuel charges into said engine cylinder, said jerk pump assembly including:

a housing having a bore therein;

a plunger mounted for reciprocating movement in said bore;

an injection chamber defined by the space between said bore and said plunger;

means for periodically receiving and directing fuel into said injection chamber;

delivery valve means for periodically discharging fuel from said injection chamber upon development of a predetermined pressure in said injection chamber;

means for controlling the pressure in said injection chamber to control the delivery valve means and the discharge of fuel from said injection chamber, said control means comprising:

means for establishing and disestablishing outflow from said injection chamber to control the opening and closing of said delivery valve means, said means including:

a bypass valve having a valve member and a valve seat, each having corresponding mating surfaces, said valve member being movable between an open position and a closed position against said valve seat mating surface to stop and start the outflow of fuel from said injection chamber in correspondence with said open and closed positions of said bypass valve member; and operating means acting on said bypass valve means to alternately position said valve member in said open and closed position, said operating means including operator piston means moving together with said valve member and extending from said mating surface of said valve member and configured to establish a hydraulic balance of said pressure in said injection chamber acting on said valve member;

pilot valve means for controllably applying a fluid pressure on said operator piston means creating a force tending to cause said movement of said valve member, and means acting on said valve member opposing said fluid pressure force to thereby enable said movement of said valve member between said open and closed positions;

whereby establishing or disestablishing outflow from the injection chamber and the discharge of fuel from the injection chamber into an engine cylinder.

2. The jerk pump assembly according to claim 1 wherein said operating means includes an operator chamber; said operator piston means adapted to be subjected to pressure in said operating chamber for exerting a force on said operating member to move said bypass valve member to said open position upon exertion of a pressure in said operating chamber, and wherein said pilot valve means includes means for a controllably pressurizing said operator chamber.

3. The jerk pump assembly according to claim 2 wherein said pilot valve means includes an inlet passage adapted to be connected to a source of fluid pressure and a vent passage, each adapted to be controllably connected to said operating chamber, said pilot valve means further establishing communication of said inlet passage and said operating chamber in a first condition thereof and also including means establishing communication of said operating chamber with said vent passage in a second condition thereof.

4. The jerk pump assembly according to claim 3 wherein said pilot valve means includes a movable valve member and means responsive to movement of said valve member to produce said enablement of communication of said operating chamber; and electrically operated solenoid means drivingly connected to said movable valve member to cause said movement of said movable valve member in response to energization and deenergization of said solenoid means.

5. The jerk pump assembly according to claim 2 wherein said means acting on said valve member includes an operator spring urging said bypass valve member to said closed position.

6. The jerk pump assembly according to claim 3 wherein said bypass valve means valve member mating surface includes a tapered valve face formed thereon and wherein said valve seat is formed with a corresponding taper to provide said corresponding mating surface and wherein said bypass valve means valve member is movable into and out of engagement with said valve seat to achieve said establishment and disestablishment of outflow.

7. The jerk pump assembly according to claim 4 wherein said line of contact between said valve seat and said valve face with said valve member seated is at the outside diameter of said bypass valve means valve member, whereby hydraulic forces tending to unseat said valve member are avoided.

8. The jerk pump assembly according to claim 3 wherein said operating piston means comprises an operator piston drivingly connected to said bypass valve means valve member, said operator piston slidably disposed in a bore and wherein a region in said bore defines said operating chamber, whereby said fluid pressure in said operating chamber is exerted on said operating piston to thereby be exerted on said bypass valve means valve member.

9. The jerk pump assembly according to claim 8 wherein said bypass valve means valve member and said operator piston are of equal diameter and in substantial alignment with each other and further including means fixing said operator piston and said bypass valve means valve member for axial movement theretogether; and wherein said valve face is disposed on one end of said bypass valve member adjacent to said point of connection with said operating piston, to thereby achieve said balance of hydraulic forces acting on said operating piston and on said bypass valve means valve member.

10. The jerk pump assembly according to claim 1 wherein said means for periodically receiving and directing fuel into said injection chamber includes a fluid flow path through said bypass valve means open only with said bypass valve means in said open condition, whereby filling of said injection chamber occurs only upon said bypass valve means being in said open condition.

11. In an improved fuel injector arrangement for use in an internal combustion engine, said injector arrangement of the type having a housing having a bore formed therein, a plunger mounted for reciprocation in said bore, an injection chamber defined by a space between said plunger and said bore, means for receiving and directing fuel to said injection chamber to be pressurized by said reciprocation of said plunger in said barrel bore, and means for discharging pressurized fuel from said injection chamber when fuel therein reaches a predetermined pressure, the improvement comprising:

bypass valve means for controlling the pressure developed in said injection chamber including a valve member and a valve seat, said valve member having an open position with respect to said valve seat for discharging fuel from said injection chamber, thereby reducing the pressure of any fuel in said injection chamber and a closed position with respect to said valve seat for preventing the discharge of fuel from said injection chamber thereby allowing the pressure of fuel in said injection chamber to increase; and operating means to alternately position said valve member in said open and closed position, said operating means including operator piston means moving together with said valve member and extending from said mating surface of said valve member and configured to establish a hydraulic balance of said pressure in said injection chamber acting on said valve member;

pilot valve means for controllably applying a fluid pressure on said operator piston means creating a force tending to cause said movement of said valve member, and means acting on said valve member opposing said fluid pressure force to thereby enable said movement of said valve member between said open and closed positions.

12. The fuel injector arrangement according to claim 11 wherein said pilot valve means includes an electromagnetically operated three-way valve, and wherein said operating means includes an operating pressure chamber and means for enabling communication of a fluid pressure source with said operating chamber by said three-way valve in a first condition of said three-way valve and in a second condition of said three-way valve enabling communication of said operating pressure chamber with a relatively low pressure region.

13. The fuel injector arrangement according to claim 11 wherein said operating means includes means causing movement of said valving member to said position corresponding to establishment of said bypass flow upon connection of said operating pressure chamber to said low pressure region and movement of said valve member by said means acting on said valve member opposing said fluid pressure force to said closed position of said valve member.

14. The fuel injector arrangement according to claim 13 wherein said valve member includes a tapered valve face and wherein said valve seat is formed with a corresponding taper, and wherein said bypass valve means further includes means mounting said valve member for movement of said valve face into and out of engagement with said valve seat, said valve seat defining an outflow passage in communication with said injection chamber with said valve member unseated, whereby upon movement of said bypass valve member into engagement with said valve seat, communication of said outflow passage with said injection chamber is disestablished to enable said pressurization in said injection chamber to occur.

* * * * *